United States Patent [19]

Cysewski

[11] Patent Number: 4,887,393

[45] Date of Patent: Dec. 19, 1989

[54] GATE ASSEMBLY

[76] Inventor: Jerome Cysewski, P.O. Box 1998, Billings, Mont. 59103

[21] Appl. No.: 254,715

[22] Filed: Oct. 7, 1988

[51] Int. Cl.[4] ..... E05D 7/00

[52] U.S. Cl. ..... 49/385; 49/386; 49/340

[58] Field of Search ..... 49/385, 386, 332, 340, 49/445

[56] References Cited

U.S. PATENT DOCUMENTS

| | | | |
|---|---|---|---|
| 2,791,796 | 5/1957 | Haas | 49/445 |
| 3,839,826 | 10/1974 | Ries | 49/385 |
| 4,470,221 | 9/1984 | Courtis | 49/385 |
| 4,481,737 | 11/1984 | Rebhan | 49/385 |

*Primary Examiner*—Kenneth J. Dorner
*Assistant Examiner*—Gerald A. Anderson
*Attorney, Agent, or Firm*—Richard C. Conover

[57] ABSTRACT

A counterbalancing assembly for use with a gate vertically rotatable about an axle carried by a support structure. The counterbalancing assembly utilizes a coil spring having one end attached to the support structure and having its other end attached to one end of a cable. The other end of the cable is attached to the gate at a point spaced apart from the axle. This cable, intermediate its ends, is trained around a pulley. The pulley is positioned so that as the gate is lifted, the spring provides a resilient force assisting in the opening of the gate and, as the center of gravity of the gate crosses over the axle and the gate starts to fall on the other side of the axle, the spring provides a force counteracting this falling movement. With this arrangement, the coil spring also assists in closing the gate from the open position.

6 Claims, 2 Drawing Sheets

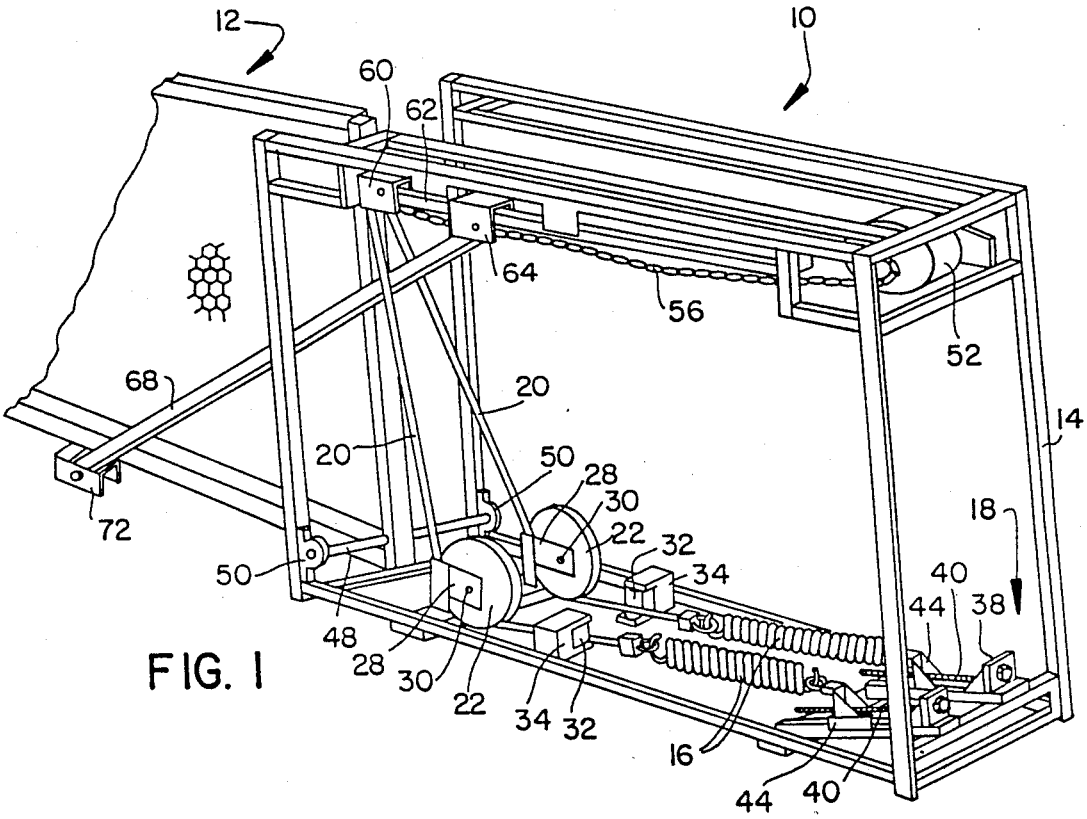
FIG. 1
FIG. 2
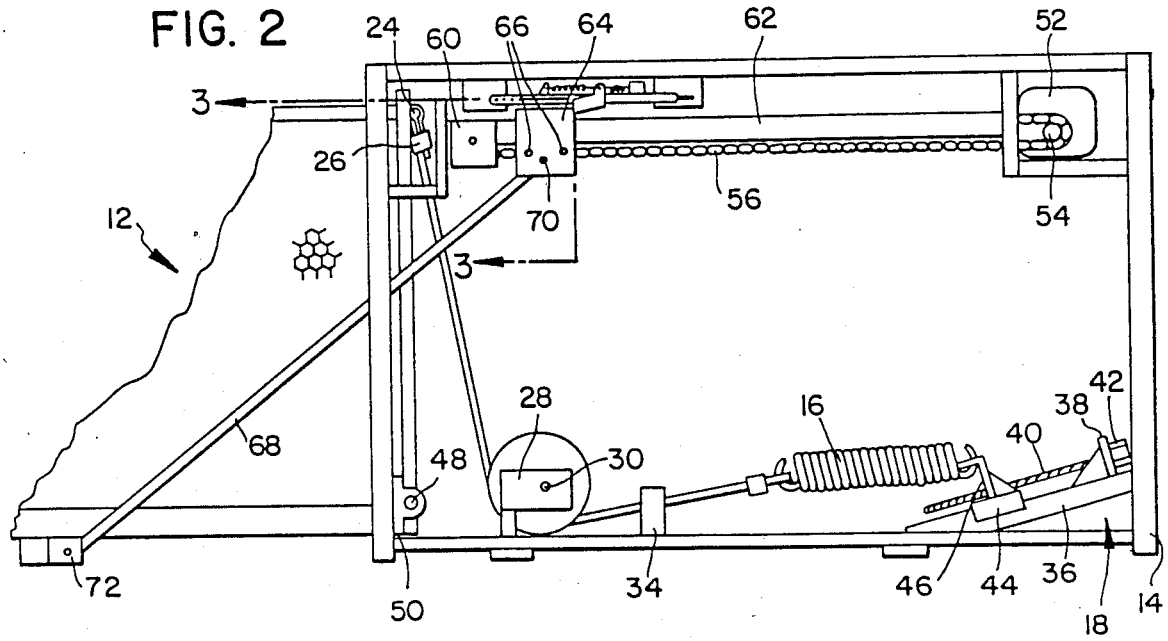

GATE ASSEMBLY

BACKGROUND OF THE INVENTION

This invention relates to an assembly for opening and closing a gate vertically rotatable about an axle. More particularly, the invention relates to a counterbalancing assembly used to counterbalance the weight of the gate.

With vertically rotatable gates, it is common to provide a counterbalancing assembly to counter the weight of the gate as the gate is rotated about its axle. If the counterbalancing assembly is not provided, it is difficult to open the gate. Previously, these counterbalancing assemblies have used weights to counterbalance the weight of the gate. These weights are mounted to the gate on the side of the axle opposite the gate. These weight driven assemblies are illustrated by U.S. Pat. No. 1,611,367 to Pickett.

It also has been recognized that when the center of gravity of the gate moves to the other side of the axle, the gate falls under the influence of gravity. In these weight driven systems, a spring was often used to cushion the fall. See U.S. Pat. No. 1,257,333 to Fawick.

An improvement on the weight driven counterbalance systems was provided in U.S. Pat. No. 1,386,113 to Houck. In the Houck patent, a cable is attached to the axle-end of the gate and to a weight which is suspended from one end thereof. The cable and weight assembly is used to counterbalance the weight of the gate both when the gate is in the closed position and when the gate is in the opened position. However, with this device, the use of a suspended weight can be a safety hazard and, secondly, there must be a super structure for supporting weight which will provide enough clearance so that the weight will not hit the ground before the gate rotates completely.

An improvement over the weight driven systems is illustrated in U.S. Pat. No. 3,839,826 to Reis which illustrates in FIG. 4 a spring operated counterbalance system. In this patent, a coil spring assists in opening the vertically rotatable gate and, as the gate opens, it begins to load a separate torsion spring. Here the torsion spring cushions the gate as it falls to the open position and further assists in closing the gate once it has been opened.

Another spring counterbalancing device is shown in U.S. Pat. No. 4,481,737 to Rebhan. In this device, a coil spring assists in opening the gate and a second coil spring is placed in tension as the gate is opened. This second spring assists in closing the gate once it is opened.

In the above two patents, where springs were used instead of weights to provide a counterbalancing force, it was necessary to provide two springs to counterbalance the weight of the gate - one spring was used to counteract the weight of the gate when the gate was being opened and the second spring was used to counteract the weight of the gate when it was being closed.

U.S. Pat. Nos. 4,381,626; 4,270,221; and 4,270,312 to Courtis all show a vertically rotatable gate in which a single spring is used to provide a counterbalance force effective in both the closed and opened gate positions. The Courtis patents describe a single counterbalancing spring which is caught in its mid-portion by an arcuate spring-engaging fulcrum as the gate is being opened. Thus, a single spring provides a counterbalancing force in two directions; the particular direction being determined by the position of the gate. However, because the spring is being stretched arcuately over the fulcrum, the spring grinds against the fulcrum providing a "noisy" mechanism. Further, this grinding may be abrasive to the springs causing deterioration of the springs over time.

There have been developments with vertically rotatable gate counterbalancing assemblies over the years, however, a needs exists to have a simple, compact but effective, spring-type counterbalance assembly which is not subject to deterioration as previously known.

SUMMARY OF INVENTION

A gate opener, according to the present invention, is used in conjunction with a vertically rotatable gate where the gate rotates about an axle held by a gate support structure.

The gate counterbalancing assembly of the present invention utilizes a single coil spring having one end attached to the support structure and having its other end attached to one end of a cable. The other end of the cable is attached to the gate at a point spaced apart from the pivotal axle. This cable, intermediate its ends, is trained partially around a pulley. The pulley is positioned so that as the gate is lifted, the spring provides a resilient force assisting in the opening of the gate and, as the center of gravity of the gate crosses over the axle and the gate starts to fall on the other side of the axle, the cable trained around the pulley provides a force counteracting this falling movement. In the open position, the cable connected to the spring provides a force tending to assist in the closing of the gate. As the gate is closed and its center of gravity moves to the gate-closed side of the axle, the gate again begins to fall to the closed position. This motion, however, is resisted by the spring-cable combination.

With this arrangement, the coil spring exerts a counterbalance force throughout the gate's arc of travel without being bent along its longitudinal axis as was the case with single-spring assemblies previously known. The pulley over which the cable is trained provides structure for changing the direction of the force exerted by the spring to accomplish this result. The present invention provides a much safer, more compact, less noisy, and a more reliable device than has previously been known.

BRIEF DESCRIPTION OF THE DRAWINGS

In order that the invention may be clearly understood and readily carried into effect, a preferred embodiment of the invention will now be described, by way of example only, with reference to the accompanying drawings:

FIG. 1 is a perspective view of the gate assembly;

FIG. 2 is an elevational front view of the gate assembly with portions of the gate broken away.

DESCRIPTION OF A PREFERRED EMBODIMENT

Figure 3:
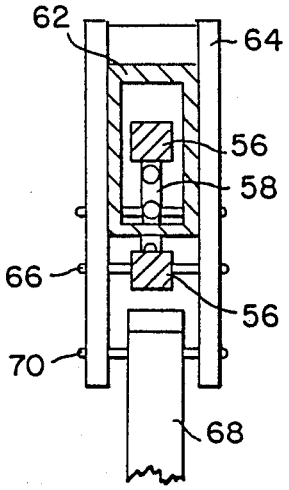
FIG. 3 is a cross-sectional view along the line 3—3 shown in FIG. 2 with background detail removed.

With reference to the drawings, gate opener 10 for lifting a gate 12 is shown. The gate opener 10 includes a support structure 14 which supports the gate rotating assembly and the counterbalancing assembly as will be described.

A counterbalancing assembly is also shown in FIG. 1. This assembly includes a pair of coil springs 16, each of which has one end attached to the support structure 14 through a tension adjusting mechanism 18. Each of the coil springs 16 has its other end connected to a cable 20. This cable 20 may be constructed of wire rope, a chain, or other flexible material. The cable 20, intermediate its ends, is partially trained around a pulley 22. The other end of cable 20 is looped around cable connector pin 24 as shown in FIG. 2 and then is clamped to itself by means of cable clamp 26. This provides a rotatable connection of the cable 20 with cable connector pin 24. The cable connector pin 24 is fixedly mounted to the gate 12.

Pulley housing 28 is rigidly connected to support structure 14 and rotatably supports a pulley axle 30. The pulley 22 is mounted on pulley axle 30 so that pulley 22 is free to rotate upon pulley axle 30.

Rollers 32 are mounted in roller support assemblies 34 which in turn are secured to the framework 14 as shown in FIG. 1. Rollers 32 guide the cable 20 by urging the cable toward the inside of the support structure 14 to prevent outward movement of the cable 20 as the cable moves back and forth around pulley 22 as will be described.

The tension adjusting mechanism 18 includes an elongate rail 36 which is rigidly attached to support structure 14. A washer 38 is secured to rail 36 as by welding. This washer 38 has an interior hole which is sized to slidably receive a bolt 40 having a head 42. An adjusting slide 44 is slidably mounted to rail 36. A nut 46 is mounted as by welding to the adjusting slide 44. This nut 46 threadably receives bolt 40. Further, the nut 46 has a hole (not shown) formed therein for receiving the end of coil spring 16. As can be seen with reference to FIG. 2, as the head of bolt 42 is turned, the adjusting slide 44 may be drawn to the right as shown in FIG. 2 to increase the tension of coil spring 16.

The gate 12 is fitted with an axle 48. The axle 48 is carried by journals 50 secured to the support structure 14.

The rotating assembly for opening the gate is also shown in FIGS. 1 and 2. This assembly includes a drive motor 52 which, in a preferred embodiment, is a remotely-controlled electric motor. A motor sprocket 54 is secured to the spindle of the motor 52. A chain 56 is looped around the motor sprocket 54 and an idler sprocket 58 (as is shown in FIG. 3) mounted in idler sprocket housing 60 as shown in FIG. 1. A track 62 extends between the motor sprocket 54 and idler sprocket 58 to guide the upper loop portion of chain 56 as it moves between the motor sprocket 54 and idler sprocket 58.

A translation member 64 slidably rests on track 62 and is mounted to the lower loop portion of chain 56 with chain pins 66 as shown in FIG. 2 and FIG. 3. As the chain 56 moves in one direction or the other, translation member 64 moves with it.

A rotator arm 68 is pivotally mounted to the translation member 64 with an arm pin 70. The other end of rotator arm 68 is pivotally mounted to the gate 12 with a connector 72.

Figure 4:
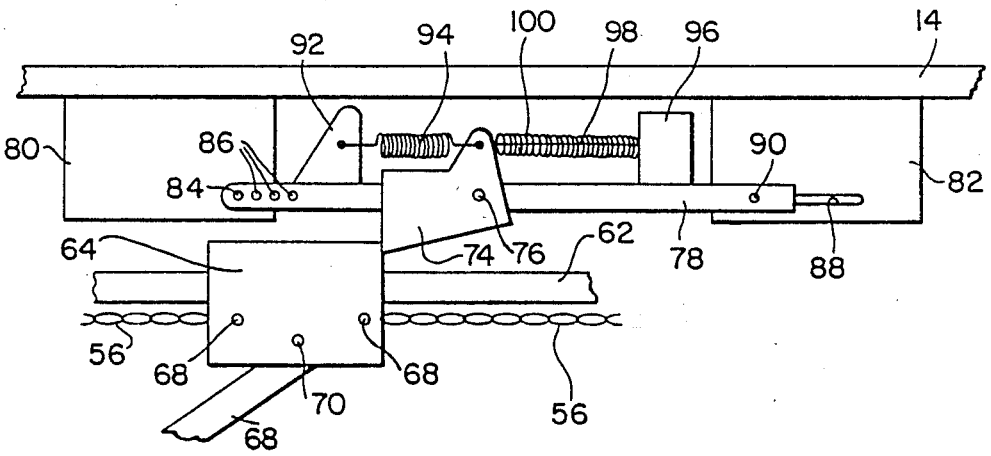

For security reasons, the translation member 64 is held in a gate-closed position by a locking pawl 74 whenever the gate is closed. The locking pawl 74 is pivotally mounted with pin 76 to a locking rail 78 as shown in FIG. 4. The pin 76 is located so that the pawl 74 normally drops in a counterclockwise direction as shown in FIG. 4. The locking rail 78 is adjustably mounted to the support structure 14 with adjustment plate 80 and slot plate 82. The plate 80 is secured to the support structure 14 as by welding and includes a bolt hole (not shown) for receiving a bolt 84. The locking rail 78 is provided with adjustment bolt holes 86 and the position of the locking rails 78 is adjusted by positioning bolt 84 in the appropriate adjustment bolt hole 86 and extending the bolt through the hole in plate 80. Plate 82 is provided with a slot 88. A bolt 90 which is secured to the locking rail 78 extends through this slot. In this manner, locking rail 78 may be bolted to slot plate 82.

A support member 92 is secured to the locking rail 78 to which is attached a tension spring 94. The other end of tension spring 94 is connected to a upwardly extending tongue of pawl 74 as shown in FIG. 4. The tension spring 94 tends to rotate the locking pawl 74 in a counterclockwise direction as shown. The locking pawl 74 in its downward-most position engages the translation member 64 and prevents movement of translation member 64 to the right as shown in FIG. 4. The locking pawl 74 is positioned to lock the translation member 64 in a position where the gate is closed.

A disengaging solenoid 96 is provided to which a solenoid shaft 98 is attached. Surrounding the solenoid shaft 98 is a tension spring 100 which normally maintains the solenoid shaft in its extended position as shown in FIG. 4. When it is desired to disengage the locking pawl 74 from translation members 64, the solenoid is actuated which draws solenoid shaft 98 to the right. The solenoid shaft is connected to the upwardly extending tongue of locking pawl 74 and rotates the locking pawl 74 around pin 76.

In a preferred embodiment, the solenoid 96 is connected to the motor 52 so that when the motor 52 is energized, the solenoid 96 is also energized. Thus, when the motor is actuated to open the gate, the locking pawl 74 is automatically rotated in a clockwise direction as shown in FIG. 4 to release the translation member 64 for movement to the right as shown in FIG. 4.

The lower portion of locking pawl 74 is shaped to provide a camming surface such that when the translator member 64 moves to the left when the gate is being closed, the left hand edge of translator members 64, as shown in FIG. 4, will cam the locking pawl 74 upwardly and then, as the translator member 64 passes the locking pawl 74, the locking pawl 74 will drop into place under the force provided by tension spring 94.

In operation, whenever the gate 12 is closed, the counterbalance cable 20 provides a component of force which urges the gate toward the open position. To open the gate, the user activates motor 52 which also energizes solenoid 96 to disengage locking pawl 74 from translation member 64. The motor 52 draws the translation member with chain 56 to the right as shown in FIGS. 1 and 2. The translation member 64, which is connected to rotator arm 68, begins to lift the gate 12 upwardly. As the gate moves upwardly to its above-center position over axle 48, the coil springs 16 provide a counterbalance force which counterbalances the weight of the gate 12. As the gate moves over the above-center position and begins to fall, the cable 20 connected to coil springs 16 which are trained around pulley 22 counteract the force of gravity and have a component which urges the gate upwardly thus providing a counterbalance force for the gate as it moves to the completely open position.

In reverse, that is when the gate is being closed from the open position, the coil springs 16 through cable 20 wrapped around pulley 22 counterbalance the weight of the gate and tend to move the gate upwardly to assist the motor 52 as the translator member 64 moves to the left as shown in FIGS. 1 and 2.

Thus, it can be seen that the counterbalancing force provided by coil spring 16 is effective in both the gate open and gate closed positions. This reduces the driving loads on the motor 52 whenever the gate is either being opened or being closed.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A gate assembly comprising:

a gate;

a support structure;

an axle;

the support structure carrying the axle;

the gate mounted to the axle for rotation about the axle;

a rotating means for rotating the gate from a closed position through an over-center position to an open position and from the open position through the over-center position to the closed position; and a counterbalancing assembly including:

a resilient means for providing a counterbalancing force to counterbalance the weight of the gate;

an adjustment means connected to the resilient means for adjusting the resilient force of the resilient means;

the resilient means having two ends with the first end being connected to the support structure;

a cable having two ends, the first end being connected to the second end of the resilient means and the second end being attached to the gate at a location spaced apart from the axle; and a pulley, mounted on the support structure;

the cable being positioned, between the ends thereof, on the periphery of the pulley to extend partially around an axis of rotation of the pulley;

the cable being connected to the gate at a position where the counterbalancing force provided by the counterbalancing assembly urges the gate from the closed position to the open position when the center of gravity of the gate is on the closed position side of the over-center position and the pulley and the connection of the cable to the gate are respectively located to urge the gate from the open position to the closed position when the center of gravity of the gate is on the open position side of the over-center position.

2. The gate assembly according to claim 1 wherein the resilient means comprises a coil spring.

3. A gate assembly comprising:

a gate;

a support structure;

an axle;

the support structure carrying the axle;

the gate mounted to the axle for rotation about the axle;

a rotating means for rotating the gate from a closed position through an over-center position to an open position and from the open position through the over-center position to the closed position;

the rotating means including:

a drive source;

a track positioned on the support structure;

a translation member positioned on the track for movement thereon from a gate-closed position to a gate-open position;

a drive means operatively connected to the drive source for moving the translation member; and an arm having one end pivotally connected to the gate at a location spaced apart from the axle and another end pivotally connected to the translation member;

a counterbalancing assembly including:

a resilient means for providing a counterbalancing force to counterbalance the weight of the gate, the resilient means having two ends with the first end being connected to the support structure;

a cable having two ends, the first end being connected to the second end of the resilient means and the second end being attached to the gate at a location spaced apart from the axle; and a pulley, mounted on the support structure;

the cable being positioned, between the ends thereof, on the periphery of the pulley to extend partially around an axis of rotation of the pulley;

the cable being connected to the gate at a position where the counterbalancing force provided by the counterbalancing assembly urges the gate from the closed position to the open position when the center of gravity of the gate is one the closed position side of the over-center position and the pulley and the connection of the cable to the gate are respectively located to urge the gate from the open position to the closed position when the center of gravity of the gate is on the open position side of the over-center position;

a disengagable locking pawl mounted to the support structure;

the translation member having means for engaging the locking pawl;

the locking pawl being positioned on the support structure to engage the translation member and lock the translation member in place when this member is positioned at the gate-closed position.

4. A gate assembly according to claim 3 wherein the drive source comprises a remotely-controlled electric motor.

5. The gate assembly according to claim 3 wherein the drive means comprises an endless loop chain.

6. The gate assembly according to claim 3 further including:

an actuatable solenoid having a retractable solenoid shaft connecting the locking pawl to the solenoid;

means for actuating the solenoid to retract the solenoid shaft;

the solenoid shaft, when retracted, being adapted to disengage the locking pawl from the translation member.

* * * * *